US007859168B2

(12) United States Patent
Banister

(10) Patent No.: US 7,859,168 B2
(45) Date of Patent: Dec. 28, 2010

(54) ACTUATOR PUMP SYSTEM

(75) Inventor: Mark Banister, Tucson, AZ (US)

(73) Assignee: Medipacs, Inc., Tucson, AZ (US)

( * ) Notice: Subject to any disclaimer, the term of this patent is extended or adjusted under 35 U.S.C. 154(b) by 633 days.

(21) Appl. No.: 11/721,800

(22) PCT Filed: Dec. 14, 2005

(86) PCT No.: PCT/US2005/045210

§ 371 (c)(1),
(2), (4) Date: Jun. 14, 2007

(87) PCT Pub. No.: WO2006/065884

PCT Pub. Date: Jun. 22, 2006

(65) Prior Publication Data

US 2008/0317615 A1 Dec. 25, 2008

Related U.S. Application Data

(60) Provisional application No. 60/730,144, filed on Oct. 24, 2005, provisional application No. 60/723,065, filed on Oct. 1, 2005, provisional application No. 60/636,256, filed on Dec. 14, 2004.

(51) Int. Cl.
*H01L 41/08* (2006.01)

(52) U.S. Cl. ..... 310/311; 310/328; 310/800; 417/322

(58) Field of Classification Search ..... 310/328, 310/330–332, 800
See application file for complete search history.

(56) References Cited

U.S. PATENT DOCUMENTS 4,034,380 A * 7/1977 Isayama ..... 347/19
4,808,084 A * 2/1989 Tsubouchi et al. ..... 417/322
4,842,493 A 6/1989 Nilsson ..... 417/322
5,327,041 A 7/1994 Culp ..... 310/328
5,798,600 A * 8/1998 Sager et al. ..... 310/330
6,074,178 A * 6/2000 Bishop et al. ..... 417/322
6,490,483 B2 12/2002 Wallis ..... 604/20
6,578,245 B1 * 6/2003 Chatterjee et al. ..... 29/25.35
6,664,718 B2 12/2003 Pelrine et al. ..... 310/800
6,682,500 B2 * 1/2004 Soltanpour et al. ..... 604/9
6,685,442 B2 2/2004 Chinn et al. ..... 417/321

(Continued)

FOREIGN PATENT DOCUMENTS

CA 2477181 4/2004

(Continued)

OTHER PUBLICATIONS

Search Report and Written Opinion received in Applicant's corresponding European Patent Application Serial No. 05854009.7, Nov. 13, 2009.

(Continued)

*Primary Examiner*—Mark Budd
(74) *Attorney, Agent, or Firm*—Hayes Soloway P.C.

(57) ABSTRACT

An actuator housing unit for a system of layered surfaces, comprising an activated primary surface having a physical shape capable of change when activated by an electrical, chemical, or light stimulus, to expand and exert force or pressure or contract and remove force or pressure, upon activation or deactivation, to move or keep matter within the housing by direct or indirect contact.

79 Claims, 3 Drawing Sheets

U.S. PATENT DOCUMENTS

| | | | | |
|---|---|---|---|---|
| 6,876,135 | B2 | 4/2005 | Pelrine et al. | 310/339 |
| 6,902,704 | B2 | 6/2005 | Wilson | 422/100 |
| 6,940,211 | B2 | 9/2005 | Pelrine et al. | 310/330 |
| 6,949,079 | B1 | 9/2005 | Westberg et al. | 604/6.11 |
| 6,955,923 | B2 | 10/2005 | Hartting | 436/180 |
| 6,960,864 | B2 | 11/2005 | Urano et al. | 310/307 |
| 2003/0156953 | A1 | 8/2003 | Chinn et al. | 417/332 |
| 2004/0234401 | A1 | 11/2004 | Banister | 417/474 |

FOREIGN PATENT DOCUMENTS

| | | |
|---|---|---|
| EP | 0 882 890 | 12/1998 |
| JP | 02 137930 | 5/1990 |
| JP | 09 287571 | 11/1997 |
| WO | WO 00/28215 | 5/2000 |
| WO | WO 2004/031581 | 4/2004 |
| WO | WO 2004/076859 | 9/2004 |

OTHER PUBLICATIONS

"An Electrochemical Microactuator: Principle and First Results", Neagu et al., Journal of Microelectromechanical Systems, vol. 5, No. 1, Mar. 1996.

"Micro-Dispensing Positive Displacement Pump", Anonymous, Research Disclosure, Mason Publications, Hampshire GB, vol. 374, No. 4, Jun. 1995.

"Magnetic Driven Compression Cascade and Packaging", IBM Technical Disclosure Bulletin, IBM Corp., col. 38, No. 1, Jan. 1995.

"Structure and Mechanism of Two Types of Micro-Pump Using Polymer Gel", Hattori et al., Micro Electro Mechanical Systems, 1992, MEMS 92, Proceedings. An Investigation of Micro Structures, Sensors, Actuators, Machines and Robot, IEEE Travemunde, Germany, Feb. 1992.

* cited by examiner

ACTUATOR PUMP SYSTEM

CROSS-REFERENCE TO RELATED APPLICATIONS

This application claims priority from U.S. Provisional Application Ser. No. 60/723,065 filed Oct. 1, 2005, and from U.S. Provisional Application Ser. No. 60/636,256 filed Dec. 14, 2004, and from U.S. Provisional Application Ser. No. 60/730,144, filed Oct. 24, 2005.

FIELD OF INVENTION

This invention concerns pumps and, more specifically, is directed to a programmable actuator pump system for moving a fluid at a determined rate and in a determined flow path.

BACKGROUND

Many kinds of pumps are known in the art and adaptations have been made for specific applications. Pumps for moving fluids are powered by motors that drive moving components, usually pistons and valves, to produce a force on a fluid that causes it to flow. Valves in such pump systems are generally activated by electromechanical devices such as solenoids and other mechanical components. As one of skill in the art will appreciate, there are countless versions of pumps for many different applications. In the medical device field, e.g., there are peristaltic pumps, diaphragm pumps and centrifuge pumps for delivering blood and other biological fluids for specific purposes. Pumps used in many of today's modern chemical processes, including oil or petroleum refining, food and drug manufacturing and electric generation, rely extensively on a complex interconnection of pumps, piping and valves to effect a particular chemical conversion or mixture. The reliance on multiple dedicated pumps or redundant valve configurations results in complex, expensive systems that require high maintenance and manufacturing costs.

Polymer actuators, requiring no moving parts, are often used in these complex systems to simplify valve operation. A class of actuators, electroactive polymers (EAP—known as artificial muscles), has recently been developed. See, e.g., "Electroactive Polymer (EAP) Activators as an Artificial Muscles" Yoseph ar-Cohen Ed., Society of Photo-Optical Instrumentation Engineers, Publisher (2001). Electroactived polymers reversibly swell or change form when activated. The mechanical force exerted by activated EAP is captured to move components in actuator devices.

U.S. Pat. No. 6,664,718 describes monolithic electroactive polymers that act as transducers and convert electrical energy to mechanical energy. The EAP are used to generate mechanical forces to move components of robots or pumps.

U.S. Pat. No. 6,682,500 describes a diaphragm pump powered by EAP. In this pump, an EAP is positioned beneath a flexible membrane termed a "diaphragm". As the EAP is activated, it swells and contracts and thereby reversibly moves the diaphragm which in turn displaces liquid in which it is in contact. The diaphragm pump uses check-flow valves to control liquid flow.

U.S. Pat. No. 6,685,442 discloses a valve actuator based on a conductive elastomeric polymer gel. In operation, the conductive gel polymer is activated by an electrolyte solution. By manipulating the potential across the gel, the motion of an elastomeric membrane over the expanding gel and the electrolyte solution can be controlled to act as a "gate" to open or close a fluid channel as a check-valve for that channel.

The use of actuators in pump systems reduces the complexity of system operation. Yet each of the disclosed pumps that incorporate polymeric actuators still requires moving parts and valves. The mechanical complexity, maintenance expense, large size and weight, sterility problems, fluid-contaminating erosion products, chemical incompatibility with certain fluids and often noisy operation, make most pump systems unsuitable for certain purposes.

The foregoing background discussion derives from my published PCT application PCT/US2004/005922 which is incorporated in its entirety, by reference, in which I describe an actuator pumping system that utilizes the force of expanding or deflecting actuators inside a housing of fixed volume to displace liquid through the housing. No moving parts or valves are required. The timed activation of individual actuators causes the actuators to change dimensions at a determined time and sequence and thereby cause the fluid to flow at a certain time and path. More particularly, as described in my aforesaid PCT application, a pump system for moving a fluid comprises an actuator housing having a chamber for housing the fluid, a plurality of contiguous actuators located in the chamber, and activating means for sequentially activating individual actuators. Each actuator, when activated, changes dimensions and exerts a displacing force on the housed fluid.

In preferred embodiments of the invention of my aforesaid PCT application, the actuator housing comprises two or more chambers in fluid connection. In certain instances, the separate chambers may be programmed to displace different segments of fluid at individualized rates and flow paths. The separate chambers may, e.g., be used to modify flow rates of fluids that change viscosity while moving through the housing. In other instances, coordination of flow rate through the separate chambers may be used to subdue any pulsing flow patterns from individual chambers into a smooth continuous fluid flow pattern downstream from the chambers.

The pump may comprise a means for controlling the actuator activating means whereby individual actuators are activated at a determined time. The controller in preferred embodiments is a programmable microprocessor in electrical connection with the activating means. Also, in certain instances, the pump may comprise a sensor means for determining physical properties of the fluid. The sensor is in electrical connection with the controlling means and provides feed-back about the physical state of the fluid to the controlling means. The sensor may, for example, measure changes in pH, viscosity, ionic strength, velocity, pressure or chemical composition of fluid. This feed-back allows the pump to interactively alter fluid flow rate and direction.

In preferred embodiments of the invention of my aforesaid PCT application, the pump moves a fluid at a controlled rate. In these embodiments, the activating means sequentially activates individual contiguous actuators at a selected time. The rate at which the fluid flows depends on the rate of actuator activation and volume displaced by each actuator. Thus, in certain preferred instances, the individual actuators are repeatedly pulsed sequentially at rapid intervals, and liquid is essentially spurted from the housing. In other instances, a first group of contiguous actuators is activated at a certain time and then, while the first group return to their original dimensions, a second group of contiguous actuators is sequentially activated. Repetition of this activation pattern for several times or with more groups of actuators along the fluid flow path causes a volume of fluid to be displaced and eventually to be ejected from the housing. The amount of fluid displaced in a given time is determined by the difference in volume between activated actuators restored activators.

As taught in my aforesaid PCT application, the chamber in the actuator housing should be sufficiently rigid to prevent it being deformed by the force exerted by activated actuators, since the displacing force of the activated actuators requires the chamber to maintain an essentially constant volume. In certain instances, however, as when the pump is to be placed into a small cavity, the actuator housing may be slightly deformable while being inserted.

Other activated pump systems described in the art include Harting in U.S. Pat. No. 6,955,923, who describes a device and method for investigating the flowability of a physiological fluid sample. This claims a device that measures various components of the blood through a pump that comprises an uptake passage for the fluid sample, an actuator device for providing cyclic change in orientation of measuring particles in the fluid sample, and a detector device for detecting the change in orientation of the measuring particles. This device also describes the movement of the fluid through the actuator in a back and forth motion. Systems for moving fluid and measuring components of the blood can be combined with molecule delivery systems within the pumping device. Westberg and Vishnoi described blood processes systems and methods using an actuated and programmable in U.S. Pat. No. 6,949,079 describes a pump system where blood is analyzed and a control and analysis system can make various programmed responses in relation to the blood components. Wilson describes an injection pump and combinatorial reactor method in U.S. Pat. No. 6,902,704 where a pathway in a plurality of injectors move to ingest, store, and discharge fluid. Multifaceted actuators will aid in the flexibility and dynamics of such pumping devices because of their varying physical properties can be manipulated to achieve a wide range of applications.

Most actuator systems described in the prior art comprise Electro Active Polymers (EAPs). Electricity can be used as an activating method for causing the material composing the actuator housing to change shape. The completion of an electrical circuit causes delivery of electrons to the shape changing material, which makes the actuator housing unit move. Once electrically activated, the material will also expand and exert force on the matter being moved through the actuator housing or will contract, relax, and relieve force or pressure from the matter and will keep it in the actuator housing.

Many actuator pumps and devices have described the use of EAPs in their composition. Pelrine, Kornbluh, and Pei described a system of electrocute polymers transducers and actuators in U.S. Pat. No. 6,940,211. The actuator system described a system composed of EAPs where one transducer moved a fluid in one direction as part of a pumping system that might be composed of many transducers. Urano and Kitahara described an EAP actuator and diaphragm pump in U.S. Pat. No. 6,960,864 where a pump is composed of several EAP tubular layers that are connected by a continuity of peripheral surfaces. Pelrine and Kornbluh used master and slave EAPs in U.S. Pat. No. 6,876,135 for a device that converts electrical to mechanical energy, where the device is composed one or two active areas.

Calvert and Liu described the "Freeform Fabrication of Hydrogels" in Acta Materialia (1998), where new kinds of hydrogels that contains multiple layers are able to exhibit multiple properties that will aid in the development of EAP actuators. They outlined a process in which novel hydrogels combine the usage of their structure to obtain certain functionalities with both chemical and thermal materials. They also described "Multilayer Hydrogels as Muscle-like Actuators" in the Journal Advanced Materials (2000) where An actuator was constructed using a combination of cross-linked polyacrylic acid and polyacrylamide hydrogels. The advantage of this particular stacking of polymers resulted in a linear rather than bent motion, which allowed control of water flow through the chamber.

Chemical methods can be used to activate the autonomous pumping and processing actuator system. The material that composes the actuator housing system changes shape upon activation involving a chemical reaction. Processing, mixing, and other reactions and chemical synthesis methods can be accomplished with the addition of heating or cooling elements, allowing temperature sensitive processes and chemical reactions to actuator housing systems. The housing actuator systems can also be used in combination with catalysts and other materials such as oxides or metals to obtain specifically desired chemical results.

Light and other photoactive elements may also be used as the activating method. Using one or more different wavelengths can produce photochemical reactions and processes. This lighted method of activation also causes a physical change in the material composing the actuator housing. These and additional energy sources may also be utilized together to generate the desired chemical or biological reactions and chemistry coupled with sensors to allow process and reaction control feedback and autonomous abilities to the system.

A specific example of an actuator composed of a light activated substance would be an epoxy based formulation of a water soluble amine such as Jeffamine and Poly Ethylene Glycol or EGDE in aqueous solution, by adding a light emitting dopant, dye or photo initiator such as Methylene Blue. The initial aqueous solution in the dye is suspended or polymerized into the epoxy. After the curing process is complete, the polymer is hydrated and swollen with aqueous solution and photo irradiation of the material, which creates a pH change within the hydrated polymer to acid. The acids swell the amines further, and the amount of swelling is tunable by changing ratios and concentrations of the epoxy components and the dye. When the irradiation is stopped, the reaction stops and the polymer relaxes back to its neutral hydrated state, thereby creating an effective photo switch mechanism for a polymer actuator.

To further refine or reverse the switching mechanism a chelator or quenching molecule can be used to reverse or rebalance the polymer at a different wavelength of light. An example of this is the use of Titanium Dioxide in the polymer to oxidize the aqueous solution, and when irradiated it produces oxygen, which can then quench the fluorescence of a dye such as a Tris(4,7-diphenyl-1,10-phenanthroline)ruthenium(II) bis(hexafluorophosphate) complex. There are many additional chemicals and compound molecules that can be used for the switching process such as functionalized dendrimers with amino or other surface groups, chemiluminescent dyes, laser dyes, photochromic dyes, phthalocyanines, porphyrins, fluoropolymers and monomers. This method is also applicable to changing the polymer ions selectivity, allowing the control of the polymers hydrophilic and hydrophobic properties in order to control the polymer swelling.

The various forms of energizing may be visible and non visible light, electrical, chemical, photochemical, electromagnetic, electrochemical, radiation, radio frequency, ultrasonic, temperature can be used in combination to allow various combinations of simultaneous functions. These functions include actuation, chemistry, application, sensing and feed back control, and processing. This allows programmed or autonomous sensing for the alteration or processing of matter in or through the system. Additional non-activated materials such as non activated hydro gels may also be encapsulated in the actuator and may perform functions or store biological fluids, chemical molecules, or cells.

SUMMARY OF THE INVENTION

The present invention is able to conduct sequential isolation, testing, and introduction of a droplet or portion of a chemical or biological fluid being passed through an actuator system, wherein one or more actuators performing different processes or reactions work in conjunction as a whole system, such as an artificial organ, an autonomous fluid processor or bio reactor to produce antibodies or cellular proliferation.

More particularly, the present invention provides many potential and possible variations of an actuator pump system. Such variations are regarded as the major benefit of this invention, where a combination of differentially activated materials can be used in various ways to move matter through the actuator housing by the transfer of momentum from the activated and shape changing substance to the matter moving through the housing. Alternatively, the momentum transfer between the actuated material and matter can be removed to keep the matter within the housing unit.

BRIEF DESCRIPTION OF THE DRAWINGS

Further features and advantages of the present invention will be seen from the following description taken in conjunction with the accompanying drawings, wherein.

DETAILED DESCRIPTION OF PREFERRED EMBODIMENTS

Figure 1:
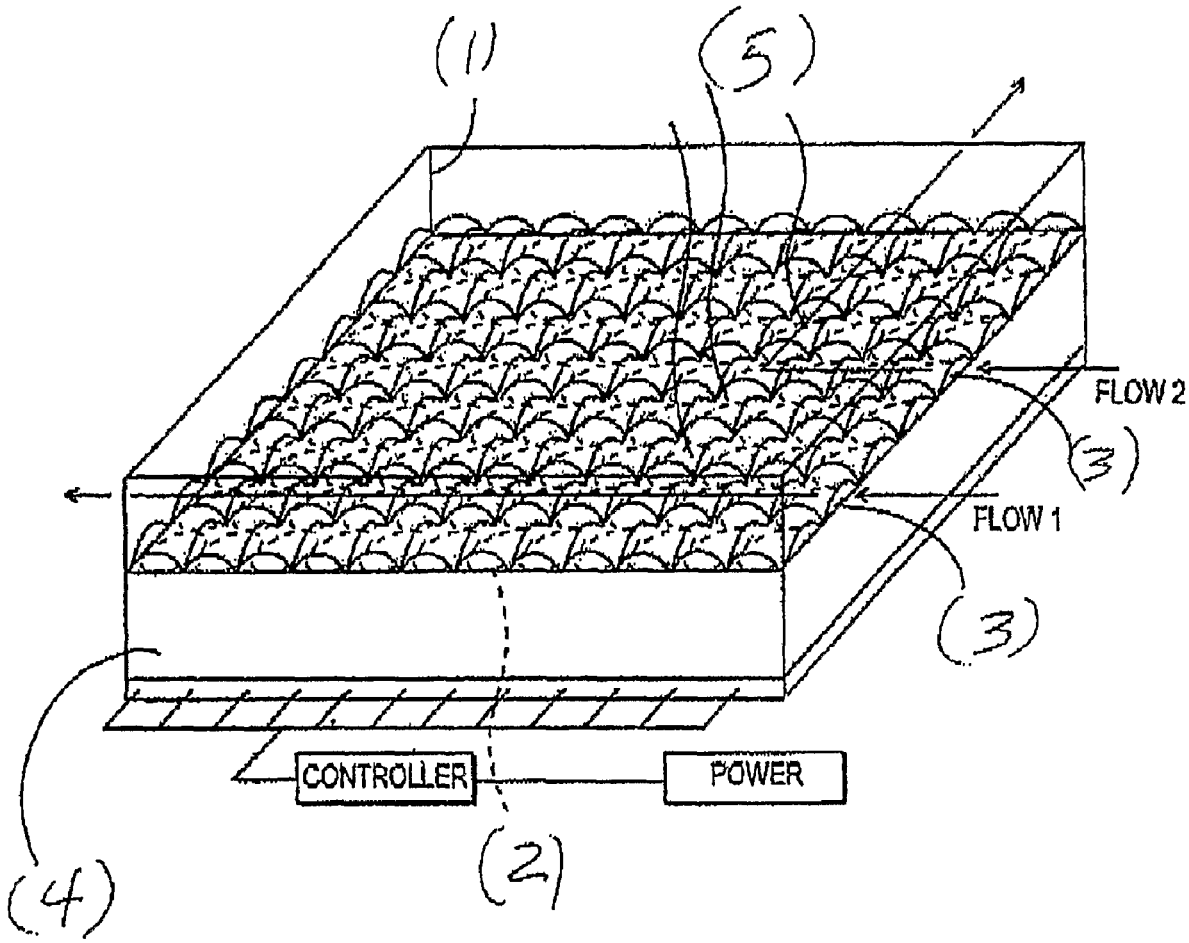
FIG. 1 is a perspective view of an array pump made in accordance with the present invention.

The system actuators of the present invention can be constructed to perform multiple functions by combining energy sources or frequencies that start, maintain and end various processes and reactions within the actuator and additionally stimulate a physical or chemical phase change at the same time.

Referring to the drawings, an actuator array pump in accordance with the present invention, when sequentially activated can move materials through connecting chambers (2) with openings (3) or ports allowing fluid connection and closing of fluid connection to predetermined locations of array. The method of activation can be electrical, hydraulic, magnetic, electromagnetic, hydrostatic, electrostatic, chemical, thermal, compressed air/gas or other mechanical actuation methods.

Figure 2:
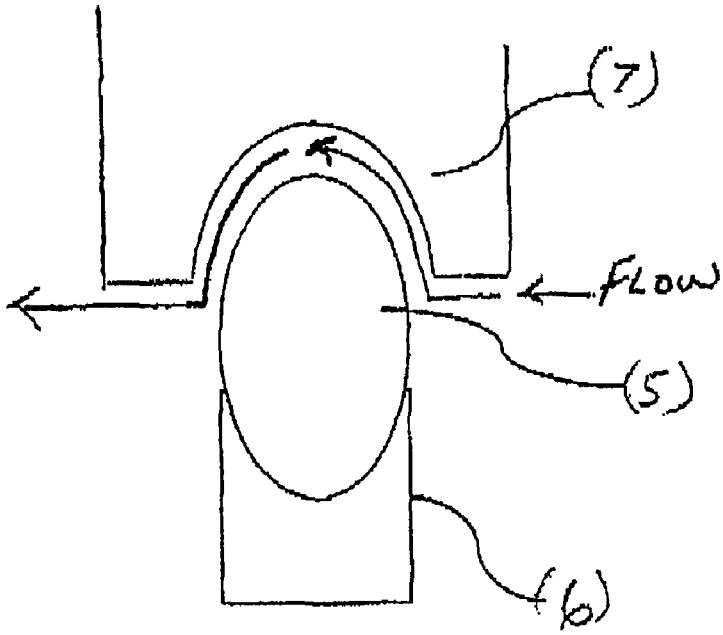
FIGS. 2 and 3 are cross-sectional views showing an individual pump chamber at the various stages of activations.
Figure 3:
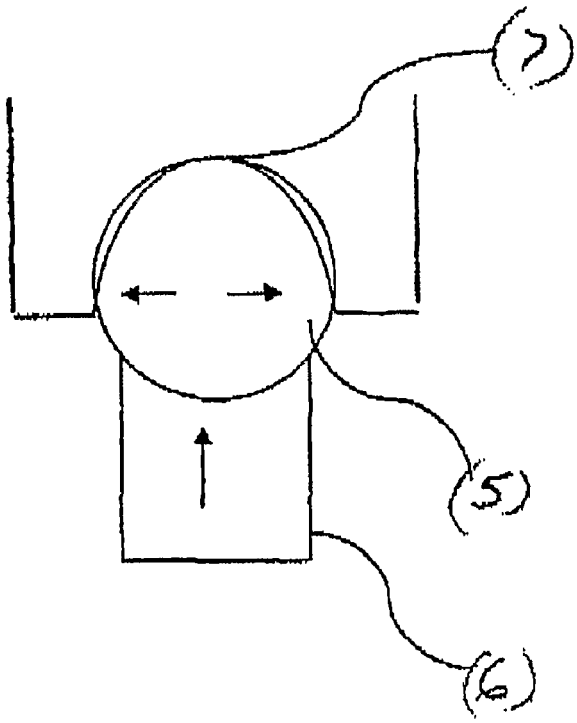

The pump includes an array housing (4) which holds and aligns actuators (6) that have contact with or are attached to a reversibly deformable member (5) (See FIG. 2). When activated the actuator moves or applies pressure to the reversibly deformable member which in turn comes in contact with the opposing housing wall (7). The deformable member upon contact with the chamber wall distorts (FIG. 3) so that as it compresses in one or more directions it distorts or expands in other directions and forces the material in the chamber through the port openings until it compresses/deforms and displaces to the point of closing or blocking the chamber port.

The deformable members may be manufactured in a sheet form to match the array, such as an elastomeric flexible gasket type material such as Nylon, Teflon, rubber, polymer composites, etc. then assembled in between the top (1) (chamber) and bottom (4) (actuator housing) of the pump. In other embodiments deformable member may be individually attached, formed, molded to the housing or to the actuator or to the opposing wall of the chamber. The single or multiple deformable members may be solid, hollow or filled with a gas, liquid, gel or viscous material to allow for the properties and efficient locomotion of the material being processed/pumped.

Further processing and reaction or chemical synthesis can be accomplished with the addition of heating or cooling elements to allow for temperature sensitive processes and chemical reactions.

Light may also be used as the activating and/or by using one or more different wavelengths can produce photochemical reactions and processes in the pump chamber or actuators or both. These and additional energy sources may also be utilized together to generate the desired chemical or biological reactions and chemistry coupled with sensors to allow process and reaction control feedback and autonomous abilities to the system.

The system actuators can be construed to perform multiple functions by combining energy sources or frequencies that start, maintain and end various processes and reactions within the actuator and additionally stimulate a physical or chemical phase change at the same time. An example of one possible actuator is an Electro Activated Polymer gel that swells when electrically charged. This gel can be encapsulated on at least one side or surface with a membrane that can also be altered upon application of energy to allow flow of a certain size molecule. The swelling is caused by absorption of a liquid, electrolyte or biological fluid into the gel. Using a light source to create a photo chemical change between the absorbed solution and chemicals or molecules suspended in the gel. The light wavelength can then be changed to create another reaction to the membrane that allows the altered chemical fluid or molecule to travel through the membrane when the electric current to the actuator is altered or stopped. Another example is the actuator could store a medication in concentration and release diluted portions at predetermined rates or in reaction to a test of another fluid.

The various forms of energizing may be visible and non visible light, electrical, chemical, photochemical, electromagnetic, radiation, temperature etc. and can be combined in various combinations to allow simultaneous functions to be performed such as actuation, chemistry, application, sensing and feed back to the controller of the processor to allow for programmed or autonomous sensing and altering or processing in or through the system.

This system would be able to conduct sequential isolation, testing, and introduction of a droplet or portion of a chemical or biological fluid being passed through the system. It is envisioned that one or more actuators performing different processes or reactions would work in conjunction as a whole system, such as an artificial organ, an autonomous fluid processor or bio reactor to produce antibodies or other cellular growth.

Figure 4:
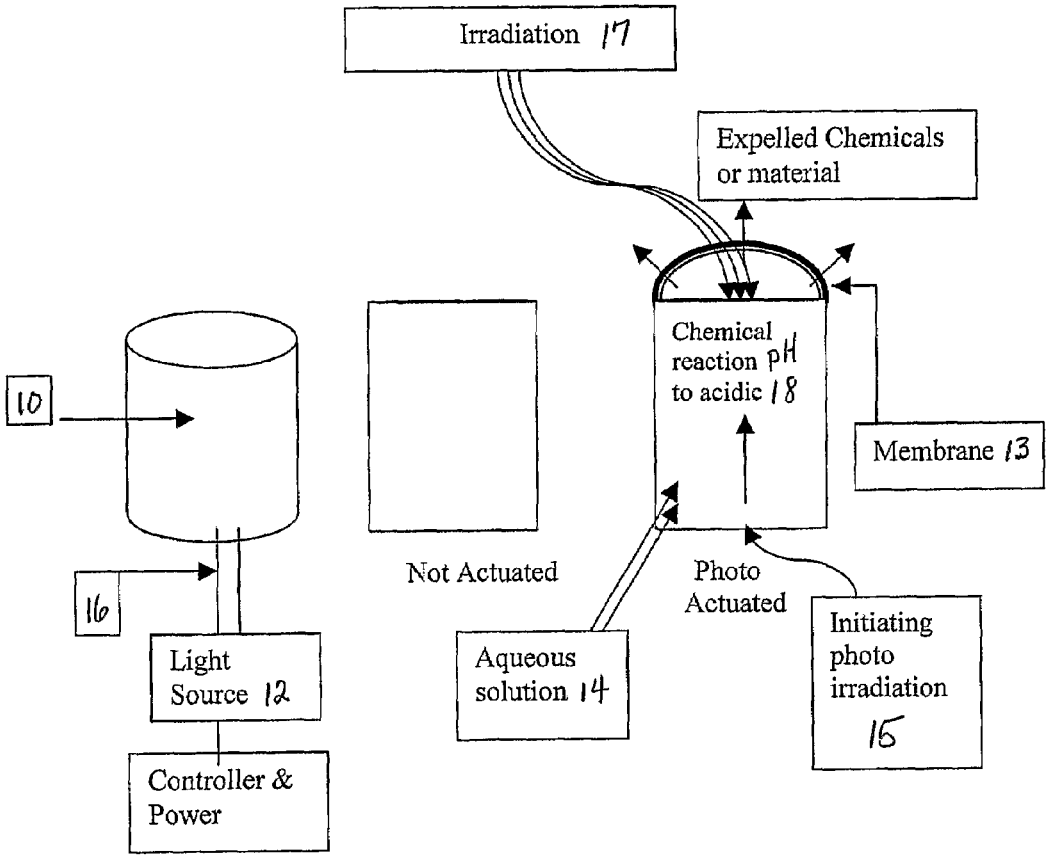
FIG. 4 diagrammatically illustrates a multi-function activator and pump system made in accordance with the present invention.

Referring to FIG. 4 there is illustrated a preferred example of actuator made in accordance with the present invention, comprises a photo activated polymer gel 10 that swells when irradiated 15 from a light source 12 such as an LED. The light is transmitted to the gel from the light sources via fiber optic 16 cable or light channel. This gel can be encapsulated on at least one side or surface with a membrane 13 that can also be altered upon application of energy or irradiation to allow flow of a certain size molecule. The swelling is caused by absorption of an aqueous solution 14, liquid, electrolyte or biological fluid into the gel, using a light source of different wavelength 17 to create a photo chemical change 18 between the absorbed solution and chemicals or molecules suspended in the gel. The light wavelength can then be changed to create another reaction to the membrane that allows the altered chemical fluid or molecule to travel through the membrane when photo irradiation to the actuator is altered or stopped. Alternatively, the actuator could store a medication in concentration and release diluted portions at predetermined rates or in reaction to a test of another fluid.

Methods which use various, activated materials, arranged in order to obtain linear motion through the properties of a polymer actuator system, can be used for a number of different purposes. The present invention provides a system which incorporates different routes of activation, in which the material responds dependently to an applied stimulus. A segmental means of various activated surfaces combines to form a system in which mechanical energy is transferred in variously activated means to control the flow of matter through the actuator housing system.

The system impedes or permits fluid within a chamber via an autonomous system that drives the activation of the material that results in the matter being expelled or retained within the actuator housing. Subsequent activation of adjacent materials is carried out by the ability of different material activation by different methods. Combinations of activated and non-activated materials can be used in the actuator housing system. A myriad of activated and non-activated materials work in concert to form a particularly desired system of movement of the matter inside of the actuator housing unit system. Thus, the system minimizes the use of materials that compose mechanically moving parts, which reduces manufacturing costs.

In one aspect, the present invention provides a design of an actuator device that utilizes the unique properties of specifically responsive materials. A physical force is obtained by the interaction of connecting two or more chambers, allowing alternate sources of activation or stimulation to occur by incorporating different energy sources that will change the morphology of the actuator housing. The actuator housing, where the matter is pushed through or retained, consists of a well that is capable of retaining fluid and capable of altering the chemical or other physical properties of any adjacent material. By inducing alternate means of activation or stimulation such as a photo, electrical, and chemical induction within the well, transferred and altered matter travels down the polymer pathway in a manner that is predetermined by the autonomous system and performed by the mechanical properties that the activated materials possess.

Chemical, electrical, and light activations or stimulations are used throughout the actuator housing system in order to achieve the preferred movement or containment of matter through the system. These alternative energy sources form a system that is scaleable for a wide range of uses. The delivery or retention of matter by isolating specific materials entrapped within the system and being able to further manipulate its structure by the introduction of various activations or stimulations allows the system to be quite versatile.

The actuator systems of the present invention can be constructed to perform multiple functions by integrating a coordinate pathway that adheres to directional flow of cardinal directions left, right, up and down. This process is mediated by combining energy sources that start and maintain processes of the characteristics of the materials that will cause reactions within the actuator well, and additionally stimulate a physical or chemical change at the same time within the an adjacent material.

The movement of the material facilitates displacement of fluid between neighboring chambers permitting a multi-flow pathway that is caused by the material reacting to a stimulus that can be interchanged to allow increasing flow control flexibility of the system. Proper material arrangement and placement within the system is dependent on the manner in which it may be activated, allowing adjacent wells to directly alter the flow of matter by other surrounding wells, such that the chambers are exchanging chemical information with each other through the addition of sequential energy sources.

As will be appreciated from the foregoing description, the polymer and mechanical actuator systems of the present invention allows programmable and autonomous pumping/processing in single or multiple paths and axis's. This includes designed and non designed options available based upon system needs and feedback from sensors such as pressure, composition, temperature, particle size or other sensing needs to process, test and evaluate material being processed, pumped or moved. The system is scaleable for a wide range of uses and industries. Further system options include modular stackability to allow for increased flexibility of system use.

Various other changes may be made in the foregoing without departing from the spirit and scope of the current invention.

The invention claimed is:

1. An actuator comprising a system of layered surfaces in a housing, comprising a first activated primary surface having a physical shape capable of change when activated by an electrical, chemical, magnetic, electromagnetic, hydrostatic, electrostatic, thermal, pressurized gas or light stimulus, to expand and exert force or pressure or contract and remove force or pressure, upon activation or deactivation, to move or keep matter within the housing by direct or indirect contact, and a second activated primary surface having a physical shape capable of change when activated by an electrical, chemical, magnetic, electromagnetic, hydrostatic, electrostatic, thermal, or light stimulus, to expand and exert force or pressure or contract and remove force or pressure, upon activation or deactivation, to move or keep matter within the housing by direct or indirect contact, wherein the stimulus that activates the first primary surface is different from the stimulus that activates the second primary surface.

2. The actuator of claim 1, wherein the activated primary surface expands and exerts force or pressure directly on the matter to move it through the actuator housing, or where the activated primary surface contracts and removes force or pressure to keep the matter within the housing.

3. The actuator of claim 1, wherein the activated primary surface is adjacent to a secondary surface, and wherein the secondary surface expands from having force or pressure exerted by contact with the activated primary surface.

4. The actuator of claim 1, wherein the activated primary surface is adjacent to a secondary surface, and wherein the secondary surface expands and exerts force or pressure directly on the matter to move it through the housing.

5. The actuator of claim 1, wherein the activated primary surface is adjacent to a secondary surface, and wherein the secondary surface contracts from having force or pressure removed from contact with the activated primary surface.

6. The actuator housing unit of claim 1, wherein the activated primary surface is adjacent to a secondary surface, and wherein the secondary surface contracts and removes force or pressure to keep the matter within the housing.

7. An actuator comprising a system of layered surfaces in a housing, comprising:

a first activated primary surface having a physical shape capable of change when activated by an electrical, chemical, magnetic, electromagnetic, hydrostatic, electrostatic, thermal, or light stimulus, to expand and exert force or pressure or contract and remove force or pressure, upon activation or deactivation, to move or keep matter within the housing by direct or indirect contact; and a second activated surface adjacent to the first activated surface wherein one activated surface is activated by a change initiated by the adjacent activated surface and where the stimulus is an electrical, chemical, or light product of the adjacent activated surface.

8. The actuator of claim 1, wherein the activated primary surface properties are used as a timing mechanism to move matter through or keep matter within the actuator housing by applying a force or pressure to achieve a desired flow rate of the matter through the housing.

9. The actuator of claim 1, wherein an inlet/outlet system or valve controls addition or removal of matter to the housing.

10. The actuator of claim 1, wherein actuation is achieved by electrical, hydraulic, magnetic, electromagnetic, hydrostatic, electrostatic, chemical, thermal or compressed air gas from an auxiliary device, to add force to move matter through the housing.

11. The actuator of claim 1, further comprising an elastomeric impermeable lining located between the first and second activated surfaces and the housed fluid for preventing contact between the housing and the fluid.

12. The actuator of claim 1, wherein the housing is formed of an inert material that is non-reactive with matter in the housing.

13. The actuator of claim 1, wherein the housing is formed of a biocompatible material.

14. The actuator of claim 1, wherein the housing is formed of a material that is semi-permeable to electrolytes.

15. The actuator of claim 1, wherein the housing is formed of material that is non-permeable.

16. The actuator of claim 1, wherein the housing is formed of a reversibly responsive elastomeric material selected from the group consisting of an electroactive polymer, an electrolytically activated polymer gel, an optically activated polymer, a piezoelectric polymer, a piezoelectric ceramic material, a chemically activated polymer, a magnetically activated polymer, a shape memory polymer, and a combination of two or more of such materials.

17. The actuator of claim 1, wherein the housing is formed, at least in part, of an electroactive polymer that is directly activated by an electrical circuit.

18. The actuator of claim 1, wherein the housing is formed, at least in part, of a chemically activated polymer.

19. The actuator of claim 1, wherein the housing is formed, at least in part, of a magnetically active polymer.

20. The actuator of claim 1, wherein the housing is formed, at least in part, of a thermally active polymer.

21. The actuator of claim 1, wherein the housing is formed, at least in part, of a shape memory alloy.

22. The actuator of claim 1, wherein the housing is formed, at least in part, of a ceramic piezoelectric material.

23. The actuator of claim 1, wherein the housing is formed of a polymer and ceramic combination.

24. The actuator of claim 1, wherein the housing is formed, at least in part, of a photo responsive polymer that is controlled by exposure to radiation of a specific wavelength, natural light, a LED, or a quantum light source.

25. The actuator of claim 1, wherein the housing is formed, at least in part, of a photo responsive polymer that is ionized in the presence of light.

26. The actuator of claim 1, wherein the housing is formed, at least in part, of a photo responsive polymer that changes pH in the presence of light.

27. The actuator of claim 1, wherein the housing is formed, at least in part, of a polymer of anthracene.

28. The actuator of claim 1, wherein the housing is formed, at least in part, of an ionic polymer metal composite.

29. The actuator of claim 1, wherein the housing comprises a polymer gel activated by contact with an electrolytic solution, wherein individual polymer gels are each encased with a semipermeable material, and the actuator housing comprises a reservoir for housing electrolytic solution and a frit located between the reservoir and the housing and the activator by means of an electrical circuit whereby electrolytic solution is caused to flow through the frit and semi-permeable material from the reservoir into contact with the polymer and away from the polymer to cause reversible dimension change of the housing.

30. The actuator of claim 1, wherein the housing comprises a material whose physical and chemical properties provide for the measurement of biological, physiological, environmental, temperature, pressure and/or chemical properties of matter within the housing.

31. The actuator of claim 1, wherein the housing further contains a heating source device.

32. The actuator of claim 1, wherein the housing comprises a functioning artificial organ.

33. The actuator of claim 1, wherein the housing comprises a biological Cell proliferation device.

34. The actuator of claim 1, wherein the housing comprises a bioreactor.

35. The actuator of claim 1, wherein the housing comprises a chemistry mixer.

36. An actuator comprising a system of layered surfaces in a housing, comprising an activated primary surface having a physical shape capable of change when activated by an electrical, chemical, magnetic, electromagnetic, hydrostatic, electrostatic, thermal, or light stimulus, to expand and exert force or pressure or contract and remove force or pressure, upon activation or deactivation, to move or keep matter within the housing by direct or indirect contact, wherein the actuator housing is formed of at least one of an electroactive polymer that is directly activated by an electrical circuit, a chemically activated polymer, a magnetically active polymer, a thermally active polymer, a shape memory alloy, a photo responsive polymer that is controlled by exposure to radiation of a specific wavelength, natural light, a LED, or a quantum light source, a photo responsive polymer that is ionized by the presence of light, a photo responsive polymer that changes pH in the presence of light, a polymer of anthracene, or an ionic polymer metal composite.

37. The actuator of claim 36, wherein the housing is formed of a chemically activated polymer.

38. The actuator of claim 36, wherein the housing is formed of a magnetically active polymer.

39. The actuator of claim 36, wherein the housing is formed of a thermally active polymer.

40. The actuator of claim 36, wherein the housing is formed of a shape memory alloy.

41. The actuator of claim 36, wherein the housing is formed of a photo responsive polymer that is controlled by exposure to radiation of a specific wavelength, natural light, a LED, or a quantum light source.

42. The actuator of claim 36, wherein the housing is formed of a photo responsive polymer that is ionized by the presence of light.

43. The actuator of claim 36, wherein the housing is formed of a photo responsive polymer that changes pH in the presence of light.

44. The actuator of claim 36, wherein the housing is formed of a polymer of anthracene.

45. The actuator of claim 36, wherein the housing is formed of an ionic polymer metal composite.

46. The actuator of claim 36, wherein the housing comprises a functioning artificial organ, a biological Cell proliferation device, or chemistry mixer.

47. An actuator comprising a system of layered surfaces in a housing, comprising an activated primary surface having a physical shape capable of change when activated by an electrical, chemical, magnetic, electromagnetic, hydrostatic, electrostatic, thermal, or light stimulus, to expand and exert force or pressure or contract and remove force or pressure, upon activation or deactivation, to move or keep matter within the housing by direct or indirect contact, wherein the housing comprises a polymer gel activated by contact with an electrolytic solution, wherein individual polymer gels are each encased with a semipermeable material, and the actuator housing comprises a reservoir for housing electrolytic solution and a frit located between the reservoir and the housing and the activator by means of an electrical circuit whereby electrolytic solution is caused to flow through the frit and semi-permeable material from the reservoir into contact with the polymer and away from the polymer to cause reversible dimension change of the housing.

48. An actuator comprising a system of layered surfaces in a housing, comprising an activated primary surface having a physical shape capable of change when activated by an electrical, chemical, magnetic, electromagnetic, hydrostatic, electrostatic, thermal, or light stimulus, to expand and exert force or pressure or contract and remove force or pressure, upon activation or deactivation, to move or keep matter within the housing by direct or indirect contact, wherein the housing comprises a material whose physical and chemical properties provide for the measurement of biological, physiological, environmental, temperature, pressure and/or chemical properties of matter within the housing.

49. An actuator comprising for a system of layered surfaces in a housing, comprising an activated primary surface having a physical shape capable of change when activated by an electrical, chemical, magnetic, electromagnetic, hydrostatic, electrostatic, thermal, or light stimulus, to expand and exert force or pressure or contract and remove force or pressure, upon activation or deactivation, to move or keep matter within the housing by direct or indirect contact, wherein the housing further contains a heating source device.

50. The actuator of claim 49, wherein the activated primary surface expands and exerts force or pressure directly on the matter to move it through the housing, or where the activated primary surface contracts and removes force or pressure to keep the matter within the housing.

51. An actuator comprising a system of layered surfaces in a housing, comprising an activated primary surface having a physical shape capable of change when activated by an electrical, chemical, or light stimulus, to expand and exert force or pressure or contract and remove force or pressure, upon activation or deactivation, to move or keep matter within the housing by direct or indirect contact, wherein the housing is formed of a material that is semi-permeable to electrolytes.

52. The actuator of claim 49, wherein the activated primary surface is adjacent to a secondary surface, and wherein the secondary surface expands from having force or pressure exerted by contact with the activated primary surface.

53. The actuator of claim 49, wherein the activated primary surface is adjacent to a secondary surface, and wherein the secondary surface expands and exerts force or pressure directly on the matter to move it through the housing.

54. The actuator of claim 49, wherein the activated primary surface is adjacent to a secondary surface, and wherein the secondary surface contracts from having force or pressure removed from contact with the activated primary surface.

55. The actuator of claim 49, wherein the activated primary surface is adjacent to a secondary surface, and wherein the secondary surface contracts and removes force or pressure to keep the matter within the housing.

56. The actuator of claim 49, wherein one activated surface is adjacent to another activated surface where either activated surface can either expand and exert force or pressure to move the matter through the housing or can contract and remove force or pressure to keep the matter within the housing.

57. An actuator comprising a system of layered surfaces in a housing, comprising a plurality of activated surfaces including an activated primary surface having a physical shape capable of change when activated by an electrical, chemical, or light stimulus, to expand and exert force or pressure or contract and remove force or pressure, upon activation or deactivation, to move or keep matter within the housing by direct or indirect contact, wherein one activated surface is adjacent to another activated surface and where one activated surface is activated by a change initiated by the adjacent activated surface and where the stimulus is an electrical, chemical, or light product of the adjacent activated surface.

58. The actuator of claim 57, wherein the activated primary surface expands and exerts force or pressure directly on the matter to move it through the housing, or where the activated primary surface contracts and removes force or pressure to keep the matter within the housing.

59. The actuator of claim 57, wherein the activated primary surface is adjacent to a secondary surface, and wherein the secondary surface expands from having force or pressure exerted by contact with the activated primary surface.

60. The actuator of claim 57, wherein the activated primary surface is adjacent to a secondary surface, and wherein the secondary surface expands and exerts force or pressure directly on the matter to move it through the housing.

61. The actuator of claim 57, wherein the activated primary surface is adjacent to a secondary surface, and wherein the secondary surface contracts from having force or pressure removed from contact with the activated primary surface.

62. The actuator of claim 57, wherein the activated primary surface is adjacent to a secondary surface, and wherein the secondary surface contracts and removes force or pressure to keep the matter within the housing.

63. The actuator of claim 57, wherein one activated surface is adjacent to another activated surface where either activated surface can either expand and exert force or pressure to move the matter through the housing or can contract and remove force or pressure to keep the matter within the housing.

64. The actuator of claim 57, wherein the activated primary surface properties are used as a timing mechanism to move matter through or keep matter within the housing by applying a force or pressure to achieve a desired flow rate of the matter through the housing.

65. The actuator of claim 57, wherein an inlet/outlet system or valve controls addition or removal of matter to the housing.

66. The actuator of claim 57, wherein actuation is achieved by electrical, hydraulic, magnetic, electromagnetic, hydrostatic, electrostatic, chemical, thermal or compressed air gas from an auxiliary device, to add force to move matter through the housing.

67. The actuator of claim 57, further comprising an elastomeric impermeable lining located between the activated surface and the housed fluid for preventing contact between the housing and the fluid.

68. The actuator of claim 49, wherein the material forming the housing is selected from the group consisting of an inert material that is non-reactive with matter in the housing; a biocompatible material; a material that is semi-permeable to electrolytes; a material that is a non-permeable, reversibly responsive elastomeric material selected from the group consisting of an electroactive polymer, an electrolytically activated polymer gel, an optically activated polymer, a piezoelectric polymer, a piezoelectric ceramic material, a chemically activated polymer, a magnetically activated polymer, a shape memory polymer, and a combination of two or more of such materials, an electroactive polymer that is directly activated by an electrical circuit; a chemically activated polymer, a magnetically activated polymer; a thermally activated polymer, a shape memory alloy, a ceramic piezoelectric material, a polymer and ceramic combination, photo responsive polymer that is controlled by exposure to radiation of a specific wavelength, natural light, a LED, or a quantum light source, a photo responsive polymer that is ionized in the presence of light, a photo responsive polymer that changes pH in the presence of light, a polymer of anthracene, an ionic polymer metal composite, a polymer gel activated by contact with an electrolytic solution, wherein individual polymer gels are each encased within a semipermeable material, and the housing comprises a reservoir for housing electrolytic solution and includes a frit located between the reservoir and the housing and an electrical actuator an activator circuit, whereupon activation of the activator causes electrolytic solution to flow through the fit and semi-permeable material from the reservoir into contact with the polymer and away from the polymer to cause reversible dimensional change of the housing, and a material whose physical and chemical properties provide for a measurement of biological, physiological, environmental, temperature, pressure and/or chemical properties of matter within the housing.

69. The actuator of claim 49, wherein the housing further contains a heating source device.

70. The actuator of claim 49, wherein the housing comprises a functioning artificial organ, a biological Cell proliferation device, a bioreactor or a chemistry mixture.

71. The actuator of claim 49, wherein the activated primary surface properties are used as a timing mechanism to move matter through or keep matter within the housing by applying a force or pressure to achieve a desired flow rate of the matter through the housing.

72. The actuator of claim 49, wherein an inlet/outlet system or valve controls addition or removal of matter to the housing.

73. The actuator of claim 49, wherein actuation is achieved by electrical, hydraulic, magnetic, electromagnetic, hydrostatic, electrostatic, chemical, thermal or compressed air gas from an auxiliary device, to add force to move matter through the housing.

74. The actuator of claim 49, further comprising an elastomeric impermeable lining located between the activated surface and the housed fluid for preventing contact between the housing and the fluid.

75. The actuator of claim 57, wherein the material forming the housing is selected from the group consisting of an inert material that is non-reactive with matter in the housing, a biocompatible material, a reversibly responsive elastomeric material selected from the group consisting of an electroactive polymer, an electrolytically activated polymer gel, an selected from the group consisting of an electroactive polymer, an electrolytically activated polymer gel, an optically activated polymer, a piezoelectric polymer, a piezoelectric ceramic material, a chemically activated polymer, a magnetically activated polymer, a shape memory polymer, and a combination of two or more of such materials, an electroactive polymer that is directly activated by an electrical circuit, a chemically activated polymer, a magnetically activated polymer, a thermally activated polymer, a shape memory alloy, a ceramic piezoelectric material, a polymer and ceramic combination, a photo responsive polymer that is controlled by exposure to radiation of a specific wavelength, natural light, a LED, or a quantum light source, a photo responsive polymer that is ionized in the presence of light, a photo responsive polymer that changes pH in the presence of light, a polymer of anthracene, an ionic polymer metal composite, a polymer gel activated by contact with an electrolytic solution, wherein individual polymer gels are each encased within a semipermeable material, and the housing comprises a reservoir for housing electrolytic solution and includes a fit located between the reservoir and the housing and an electrical actuator and activator circuit, whereupon activation of the actuator causes electrolytic solution to flow through the frit and semipermeable material from the reservoir into contact with the polymer and away from the polymer to cause reversible dimensional change of the housing, and a material whose physical and chemical properties provide for a measurement of biological, physiological, environmental, temperature, pressure and/or chemical properties of matter within the housing.

76. The actuator of claim 57, wherein the housing further contains a heating source device.

77. The actuator of claim 57, wherein the housing comprises a functioning artificial organ, a biological Cell proliferation device, a bioreactor, or a chemistry mixer.

78. An actuator for a system of layered surfaces, comprising an activated primary surface having a physical shape capable of change when activated by an electrical, chemical, or light stimulus, to expand and exert force or pressure or contract and remove force or pressure, upon activation or deactivation, to move or keep matter within the housing by direct or indirect contact, wherein the housing comprises a functioning artificial organ, a biological Cell proliferation device, a bioreactor or a chemical mixer.

79. The actuator of claim 78, wherein the housing further contains a heating source device.

* * * * *